US006435671B1

(12) United States Patent
Kim et al.

(10) Patent No.: US 6,435,671 B1
(45) Date of Patent: Aug. 20, 2002

(54) ACTUATOR FOR INKJET PRINT HEAD

(75) Inventors: Il Kim, Suwon-Shi; Young Seuck Yoo, Seoul, both of (KR)

(73) Assignee: Samsung Electro-Mechanics Co., Kyungki-Do (KR)

( * ) Notice: Subject to any disclaimer, the term of this patent is extended or adjusted under 35 U.S.C. 154(b) by 0 days.

(21) Appl. No.: 09/452,743

(22) Filed: Dec. 1, 1999

(30) Foreign Application Priority Data

Jan. 25, 1999 (KR) ..... 99-2292

(51) Int. Cl.[7] ..... B41J 2/045
(52) U.S. Cl. ..... 347/68
(58) Field of Search ..... 347/68, 70, 71

(56) References Cited

U.S. PATENT DOCUMENTS 5,802,686 A * 9/1998 Shimada et al. ..... 347/70
6,171,510 B1 * 1/2001 Lee ..... 216/27

* cited by examiner

*Primary Examiner*—John E. Barlow, Jr.
*Assistant Examiner*—Ly T Tran

(74) *Attorney, Agent, or Firm*—Darby & Darby

(57) ABSTRACT

Disclosed herein is an actuator for an inkjet print head. The actuator includes a vibrating plate having a thin film structure and flexurally deformable in its thickness direction; a first etch stopper film laminated on one surface of the vibrating plate; a chamber plate laminated on the surface of the first etch stopper film opposite to the vibrating plate, and having a plurality of solution chambers formed therein and spaced apart from each other by a desired distance, the solution chambers having a width gradually larger from a middle portion and toward upper and lower portions; and a second etch stopper film laminated on the surface of the chamber plate opposite to the first etch stopper film, and including through holes therein, the through holes being formed such that they communicated vertically concentrically with the corresponding ones of the solution chambers, the through holes having a width smaller than that of the solution chambers. Therefore, the actuator is excellent in reproductivity of uniform solution chambers, and is increased in bonding area of the chamber plate to other plate structures and, therefore, is increased in bonding force of the channel plate. This allows a rigidity of the chamber plate to be increased while improving an ink jetting-out performance of the inkjet print head.

3 Claims, 6 Drawing Sheets

ACTUATOR FOR INKJET PRINT HEAD

BACKGROUND OF THE INVENTION

1. Field of the Invention

The present invention relates to an actuator for an inkjet print head, and more particularly, to an actuator for an inkjet print head, in which a chamber plate has hard etch stopper films formed at its upper and lower surfaces, respectively, and solution chamber walls arranged between solution chambers formed in the chamber plate have a thickness such that they have a smaller width at a middle portion than at a upper portion or a lower portion, thereby increasing a rigidity of the chamber plate and a bonding force of the chamber plate to a member being bonded thereto.

2. Description of the Prior Art

Generally, an inkjet printer is a kind of printer by which ink in the form of droplets is jetted out and printed onto a paper.

In such an inkjet printer, a printer head is a part on which a print quality and performance of the inkjet printer is dependent. The printer head, in the past, has employed the electrification or deflection mechanism of ink such that it is configured to require a high voltage. At present day, however, the printer head mainly uses a drop-on-demand (DOD) mechanism. Such DOD manner enables easier printing by jetting out droplets of a recording solution onto a paper under atmospheric pressure on demand.

The printer head in the inkjet printer has very various configurations depending on a driving means, but the recent printer head has configurations using a piezoelectric material, particularly oxide piezoelectric material. Among such configurations, a configuration illustrated in FIG. 1 is typically used.

As shown in FIG. 1, the inkjet printer head includes a nozzle plate 100, a reservoir plate 200, a channel plate 300, a restrictor plate 400, a chamber plate 500, and a vibrating plate 600, which are laminated in sequence. On the vibrating plate 600, there is laminated a microactuator 700 which consists of a plurality of patterned electrodes spaced apart from each other by a certain distance and a plurality of patterned oxide piezoelectric elements spaced apart from each other.

The nozzle plate 100, the reservoir plate 200, the channel plate 300, and the restrictor plate 400, which are placed below the chamber plate 500, each has a channel serving to introduce ink into a solution chamber formed on the chamber 500 or jet out ink from the solution chamber. These plates may be also partially omitted, if necessary, such that the channels of various configurations are obtained. That is to say, some of the plates may omitted, and the channels formed in the plates, thus, have various configurations, depending on an ink channel desired by a manufacturer.

Meanwhile, in the printer head including an oxide piezoelectric element as a driving means, the fabrication of the vibrating plate and the chamber plate is very critical. In other words, for an excellent performance of the printer head, the vibrating plate must have a mechanical rigidity sufficient to interlock with a driving means. Consequently, it is preferred that the vibrating plate is thinner and more uniform in thickness.

Furthermore, as the chamber plate is a part in which ink is temporarily stored, it must be sufficient in storage capacity of ink, and maintained at a stable state when introducing or jetting out ink.

For this reason, in fabricating the actuator of the inkjet printer head, there are some cases where the chamber plate is mechanically processed to form solution chambers therein. Recently, however, while the vibrating plate and the chamber plate are formed in such a manner that they are integrally coupled by a electroforming process, etc. with each other, the solution chambers in the chamber plate are formed using an etching process. This enables an increase in the rigidity of the vibrating plate, and also allows the solution chambers to be uniformly formed at the desired shape and size.

FIG. 2 is a cross-sectional view illustrating the formation of laminated plates used for an actuator in the printer head of FIG. 1. As illustrated in FIG. 2, a vibrating plate 810 and a chamber plate 820 are bonded to opposite surfaces of an etch stopper film 830 made of silver (Ag) or platinum (Pt), respectively. After that, the resulting structure is subjected to a photolithographic process on the surface of the chamber plate 820 opposite to the bonded etch stopper film to form solution chambers.

That is to say, as shown in FIG. 3, a photoresist film 840 is applied on one surface of the chamber plate 820 to a desired thickness, and the applied photoresist film 840 is exposed to light using a mask, developed, and then partially removed by a washing process to be patterned in a shape as shown in FIG. 4.

Portions of the chamber plate 820 exposed through the patterned photoresist film 840 generally have a width smaller than that of the respective solution chambers to be formed in the chamber plate 820. Where the exposed portions of the chamber plate 820 are impregnated with an etching solution as shown in FIG. 5, the chamber plate 820 is etched slowly to form the solution chambers 821. The etching solution used in the etching process etches the chamber plate 820 at a very high etching speed until the etching reaches the etch stopper film 830 by its self controlling-reaction property.

When etching vertically the chamber plate 820 until the etching solution reaches the etch stopper 830, the chamber plate 830 is also laterally etched to an etched degree similar with the vertically etched degree.

However, when the etching is vertically gradually diffused in a sequence indicated as hidden lines in FIG. 5 and reaches the etch stopper 830, the chamber plate 830 is more laterally etched in a portion adjacent to the photoresist film 840 than in a portion adjacent to the etch stopper 830. Consequently, a width of the solution chambers formed in the chamber plate is gradually larger toward the photoresist film 840.

By etching the chamber plate 820 according to the above mentioned process, the solution chambers 821 having a shape as in FIG. 6 are formed in the chamber plate 820. Then, the photoresist film 840 remaining on the upper portion of the chamber plate 840 is removed by washing again. Subsequently, on the vibrating plate 810, the electrodes 710 (see, FIG. 1) and the piezoelectric material 720 (see, FIG. 1) are formed on the vibrating plate 810 which is aligned vertically concentrically with the solution chambers 821. In this way, a print head is fabricated.

As the solution chambers so formed are shaped to have a width gradually larger from a portion on which the etch stopper 830 is laminated, solution chamber walls 822 partitioning the solution chambers are shaped to have a width gradually smaller from an end bonded to the etch stopper 830, toward the opposite end.

Meanwhile, to the end of the respective solution chamber walls 822, to which the etch stopper 830 is bonded, and to the opposite end, there is conventionally bonded a channel plate or restrictor plate, in which an ink channel for introducing ink into the solution chambers or ejecting ink from the ink chambers.

Accordingly, when the solution chamber walls 822 are formed such that their ends, to which the channel or restrictor plate is bonded, are smaller in width, as compared to that of their opposite ends, to which the etch stopper 830 is bonded, a bonding force of the solution chamber walls to the channel plate or the restrictor plate is poor, as compared with a bonding force to the etch stopper 830. This results in a reduction in the rigidity of the chamber plate 820, and makes the tightness between the solution chambers unstable.

Moreover, where the adjustment in an etching time for forming the solution chambers 821 is not accurately controlled, the chamber plate 820 is excessively etched at a portion adjacent to the photoresist film 840, while severely deforming open ends of the photoresist film 840, as shown FIG. 7. This makes a shape of the solution chambers nonuniform.

In other words, in order to make a shape of the solution chambers in the chamber plate uniform, a time for carrying out the etching needs to be controlled with accuracy. However, it is difficult to artificially control with accuracy a point of time when the etching is terminated.

In particular, difficulty in adjusting the etching time, and ununiformity in a shape of the solution chambers, lead to a variation in an ink introducing and ejecting performance of the solution chambers. This contributes to an unstable print state in the print head.

SUMMARY OF THE INVENTION

Therefore, an object of the invention is to solve the above mentioned problems and to provide an actuator for an inkjet print head, in which solution chamber walls partitioning solution chambers formed in a chamber plate have a width smaller at a middle portion than at an upper portion and a lower portion, such that the chamber plate has an increased bonding force to members bonded to thereto, thereby improving a rigidity of the chamber plate.

Moreover, another object of the present invention is to provide an actuator for an inkjet print head, in which a vibrating plate and a chamber plate are bonded by means of a first etch stopper to each other, and a second etch stopper is formed, by a photolithography process, integrally on the surface of the chamber plate opposite to the first etch stopper, such that uniform solution chambers are formed between the first and second etch stopper films by an etch process.

Still, another object of the present invention is to allow an etching process for the formation of solution chambers to be carried out more easily.

In accordance with the present invention, these objects are accomplished by providing an actuator for an inkjet print head comprising: a vibrating plate; a first etch stopper film laminated on one surface of the vibrating plate; a chamber plate laminated on the surface of the first etch stopper film opposite to the vibrating plate, the chamber plate having a plurality of solution chambers and a plurality of solution chamber walls partitioning the solution chambers, the solution chambers being formed on the chamber plate in such a manner that they have a width larger at a middle portion than at an upper portion and a lower portion and are vertically perforated, the solution chamber walls being formed on the chamber plate in such a manner that they have a width smaller at a middle portion than at an upper portion and a lower portion; and a second etch stopper film laminated on the surface of the chamber plate opposite to the first etch stopper film, the second etch stopper film including through-holes arranged while communicating vertically concentrically with the solution chambers and having a width smaller than that of the solution chambers.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
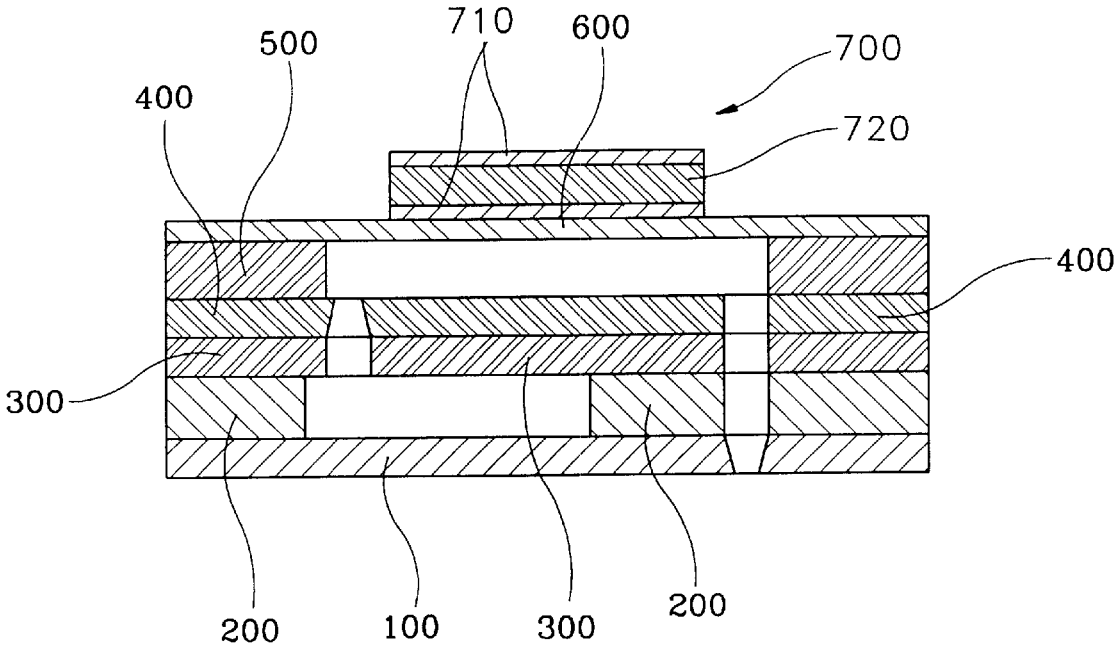
FIG. 1 is a cross-sectional view illustrating a structure of the conventional inkjet print head.
Figure 2:
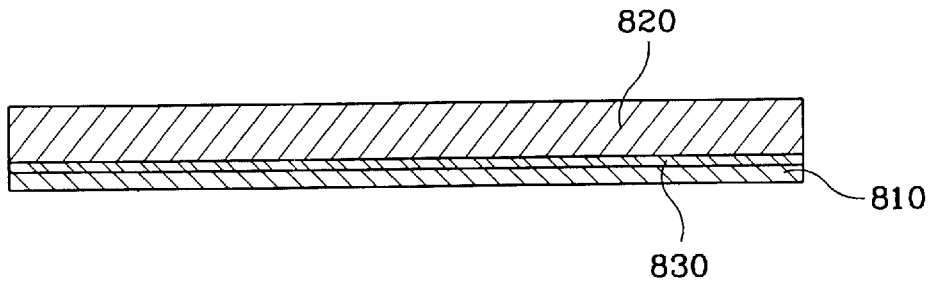
FIG. 2 is a cross-sectional view illustrating the formation of laminated plates used for an actuator in the printer head of FIG. 1.
Figure 3:
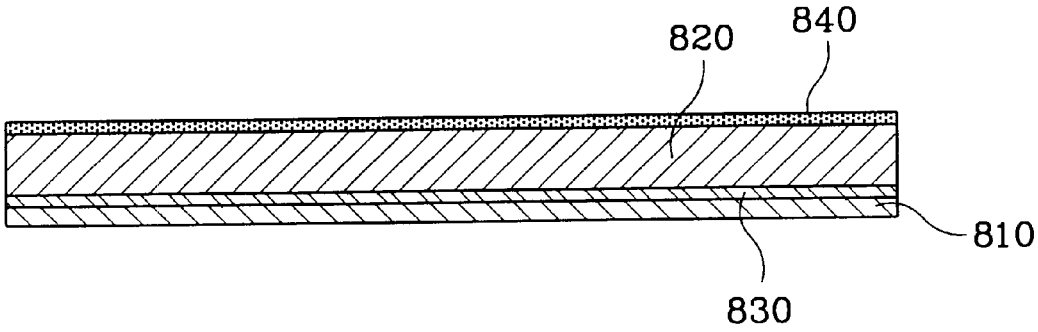
FIG. 3 is a cross-sectional view illustrating a photoresist film deposited on a chamber of FIG. 2.
Figure 4:
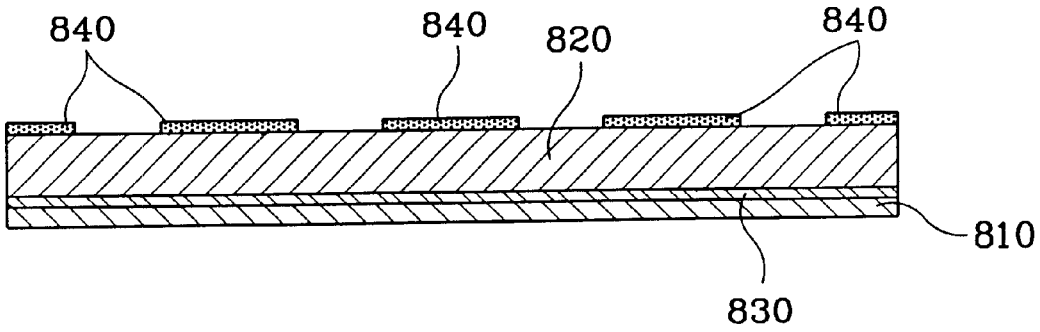
FIG. 4 is a cross-sectional view illustrating that the photoresist film of FIG. 3 is patterned.
Figure 5:
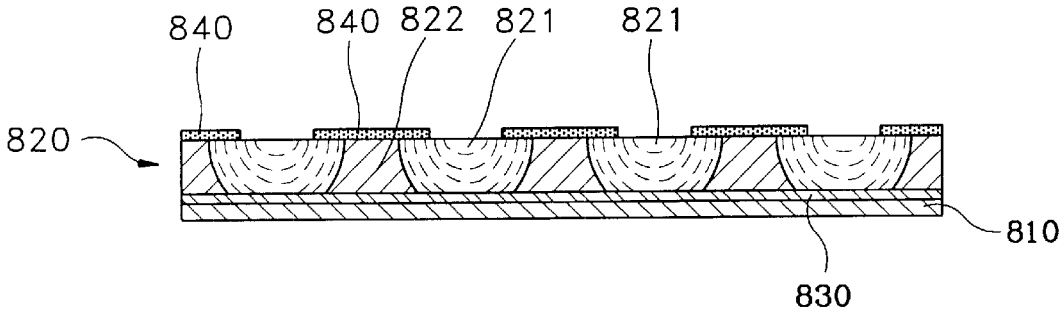
FIG. 5 is a cross-sectional view illustrating that the chamber plate of FIG. 4 is etched for forming liquid solutions.
Figure 6:
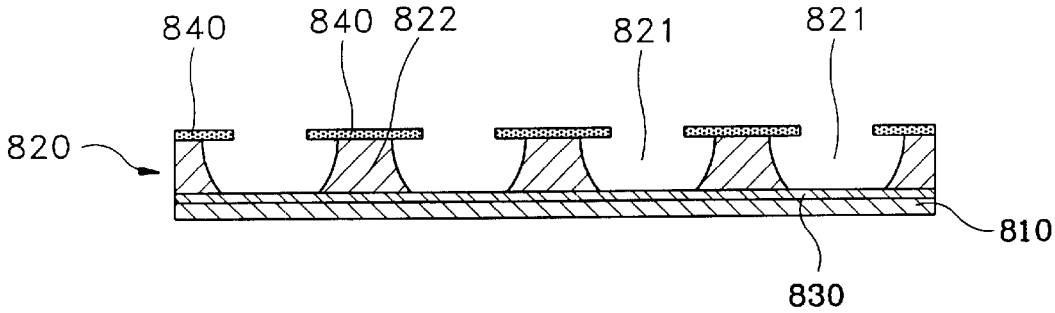
FIG. 6 is a cross-sectional view illustrating that the solution chambers are formed in the chamber plate via a process of FIG. 5.
Figure 7:
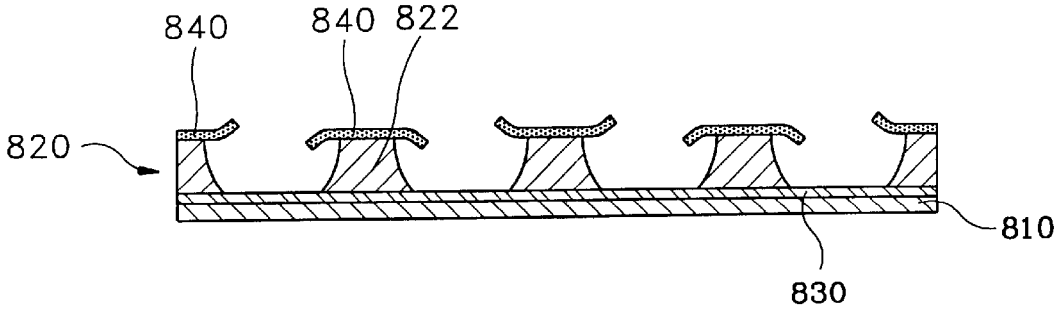
FIG. 7 is a cross-sectional view illustrating that the photoresist film is deformed during an etching process of FIG. 5.
Figure 8:
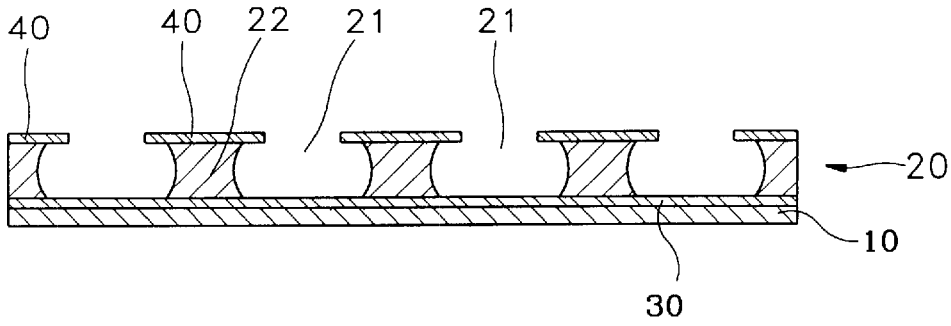
FIG. 8 is a cross-sectional view illustrating the structure of an actuator for an inkjet print head, according to the present invention.

FIG. 8 is a cross-sectional view illustrating the structure of an actuator for an inkjet print head according to the present invention. As shown in FIG. 8, an actuator for an inkjet print head in accordance with the present invention includes four thin films that are integrally laminated and consist of a vibrating plate 10, a chamber plate 20, a first etch stopper film 30, and a second etch stopper film 40. In particular, such an actuator is of a structure in which each of solution chambers 21 formed in the chamber plate 20 is laterally curved at its middle portion, such that solution chamber walls 22 partitioning the solution chambers 21 are enlarged in bonding area at an upper end and a lower end.

In the above-described actuator structure, the vibrating plate 10 is made of a metal thin film having a very thin thickness, such as 3 μm to 50 μm, and based on nickel (Ni), copper (Cu), chromium (Cr) or iron (Fe). The vibrating plate 10 is deformed flexurally in its thickness direction toward the solution chambers, thereby serving to introduce a certain amount of ink into the solution chambers 21 formed in the chamber plate 20 or to jet out ink.

The chamber plate 20 is a thin film made of a metal material, in which a plurality of solution chambers 21 spaced apart from each other by a certain distance are formed that serve to store temporarily a certain amount of ink.

The solution chambers 21 are configured to be perforated vertically through the chamber plate 20, and to be curved laterally at a middle portion such that they have a width larger at a middle portion than at an upper portion and a lower portion.

As a result, solution chamber walls 22 arranged between the adjacent solution chambers 21 and partitioning the solution chambers 21 are shaped to have a thickness smaller at a middle portion than at an upper portion and a lower portion.

The chamber plate 20 is made of a thin film based on nickel (Ni), copper (Cu), chromium (Cr) or iron (Fe), like the case of the vibrating plate 10. Also, the chamber plate 20 has a thickness of 10 μm to 500 μm which is thicker than that of the vibrating plate.

Interposed between the vibrating plate 10 and the chamber plate 20 is a first etch stopper film 30. Such a first etch stopper film serves as a bonding means allowing the vibrating plate 10 and the chamber plate 20 to be bonded firmly to each other, while serving to limit etching when patterning the solution chambers 21 formed in the chamber plate 20, such that the vibrating plate 20 is not etched by an etching solution.

Such a first etch stopper film 30 is formed of a very thin film made of a novel metal, such as silver (Ag) and platinum (Pt), and having a thickness of about 0.1 μm to 10 μm.

Meanwhile, a second etch stopper film 40 is formed on the surface of the chamber plate 20 opposite the first etch stopper film 30. Also, this second etch stopper film 40 is formed of a very thin film made of the same material as in the first etch stopper film. In such a second etch stopper film 40, a plurality of holes 41 are formed in the same number as that of the solution chambers 21. These holes 41 are placed concentrically with the corresponding ones of the solution chambers 40, and perforated vertically through the second etch stopper film 40 to be communicated with the corresponding ones of the solution chambers 21. Also, the holes 41 have a width narrower than that of the open upper portion of the respective solution chambers 21.

Such a second etch stopper film 40 is bonded, in a subsequent process, to members, such as a channel plate or a restrictor plate, which serve as a flow passage through which ink is introduced into the solution chambers or ejected from the solution chambers. When forming the solution chambers, this second etch stopper film 40 serves to limit an etching along with the first etch stopper film 30.

Figure 9:
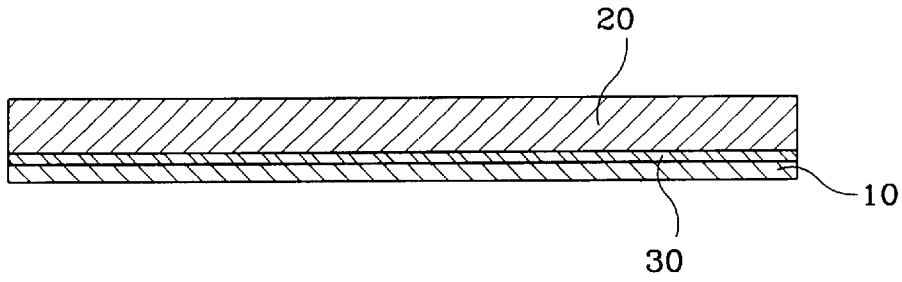
FIG. 9 is a cross-sectional view illustrating that a vibrating plate, a chamber plate, and a first etch stopper are integrally laminated for forming the actuator of FIG. 9.

Meanwhile, the vibrating plate 10, the chamber plate 20, and the first etch stopper film 30 may be laminated in accordance with various methods to fabricate the laminated plate structure as shown in FIG. 9.

For example, in one method to fabricate the laminated plate structure as shown in FIG. 9, the vibrating plate 10 and the chamber plate 20 are first made by carrying out a vapor deposition, such as an electroforming, a sputtering or an evaporation, using a separate substrate. Then, the first etch stopper film 30 is formed on one surface of the vibrating plate 10 or one surface of the chamber plate 20 to a slightly thin thickness, respectively. After that, these plates 10 and 20 are bonded to each other by melting at a high temperature. Thus, the laminated plate structure consisting of three layers is formed as shown in FIG. 9.

In another method for fabricating the laminated plate structure as shown in FIG. 9, one of either the vibrating plate 10 or the chamber plate 20 is first fabricated by an electroforming or a vapor deposition using a separate substrate. Then, the first etch stopper film 30 is formed on one surface of the fabricated vibrating plate 10 or chamber plate 20. After that, the remaining one of the vibrating plate 10 or the chamber plate 20 is vapor-deposited on the first etch stopper film 30 to fabricate the laminated plate structure as shown in FIG. 9.

Figure 10:
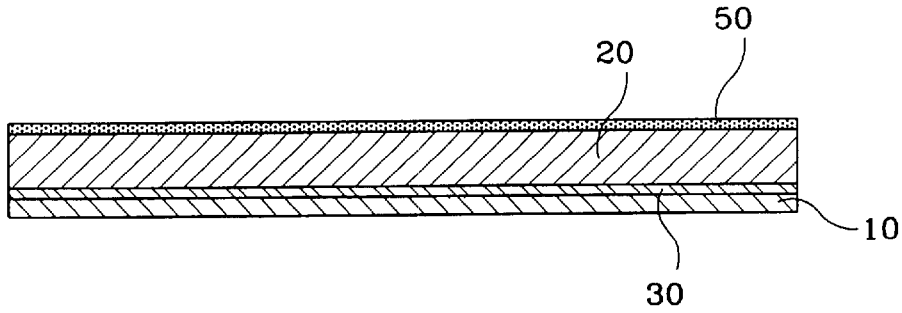
FIG. 10 is a cross-sectional view illustrating that a photoresist is applied on the chamber plate in FIG. 9.

After bonding the vibrating plate 10 and the chamber plate 20 to each other by means of the first etch stopper film as described above, a photoresist 50 is applied, to a desired thickness, on the surface of the chamber plate opposite the first etch stopper 30, as shown in FIG. 10.

Figure 11:
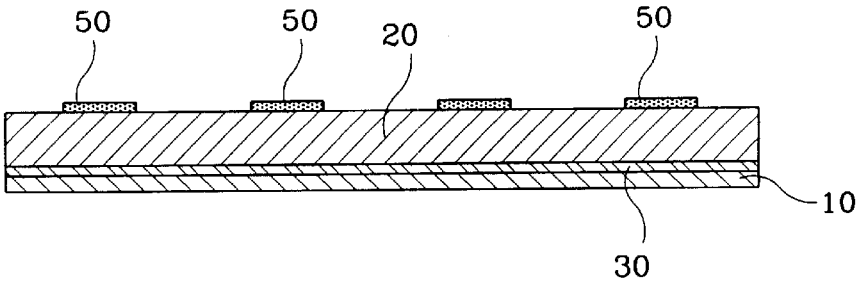
FIG. 11 is a cross-sectional view illustrating that the photoresist in FIG. 10 is patterned.

The applied photoresist 50 is cured by baking, exposed to light using a mask, developed, and then washed to be patterned as shown in FIG. 11.

In the patterned photoresist 50, there remains only photoresist portions that have a smaller size than the respective solution chambers to be formed in the chamber plate 20 and that are placed concentrically with the respective solution chambers. On the other hand, all other portions of the photoresist except for the remaining photoresist portions are removed to expose partially the surface of the chamber plate 20.

Figure 12:
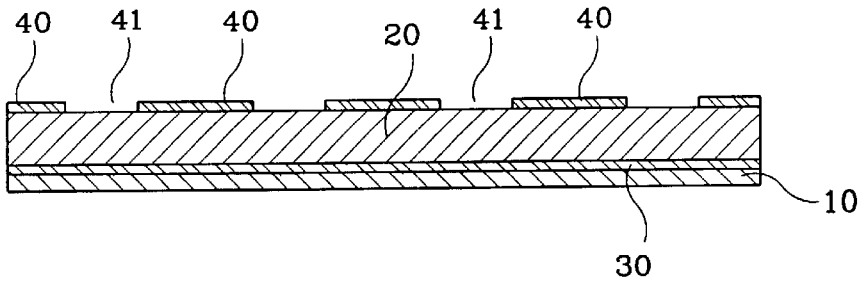
FIG. 12 is a cross-sectional view illustrating that a second etch stopper is vapor-deposited using the patterned photoresist in FIG. 11.

On the exposed surface portions of the chamber plate 20, there is vapor-deposited a second etch stopper film 40 by an electroforming or a vapor-deposition, as shown in FIG. 12. The formed second etch stopper film 40 has the same thickness and is made of the same material, as the first etch stopper film 30.

Moreover, since the thickness of the second etch stopper film depends on the thickness of the photoresist already applied on the chamber plate, it is preferred that the photoresist 50 is applied to a thickness slightly thicker than a desired thickness of the second etch stopper film 40.

After vapor-depositing the second etch stopper film 40 on the chamber plate 20, the photoresist portions remaining on the chamber plate 20 are completely removed by a washing. This, therefore, forms holes 41 that are placed at portions from which the photoresist portions are removed, and that have the same size as that of the respective photoresist portions, as shown in FIG. 12.

Meanwhile, although an etching of the chamber plate 20 may be terminated in a short period of time by making the etching speed fast at the beginning, the excessively fast etching speed results in rapid termination of the etching, thereby making a laterally etched degree nonuniform.

Figure 13:
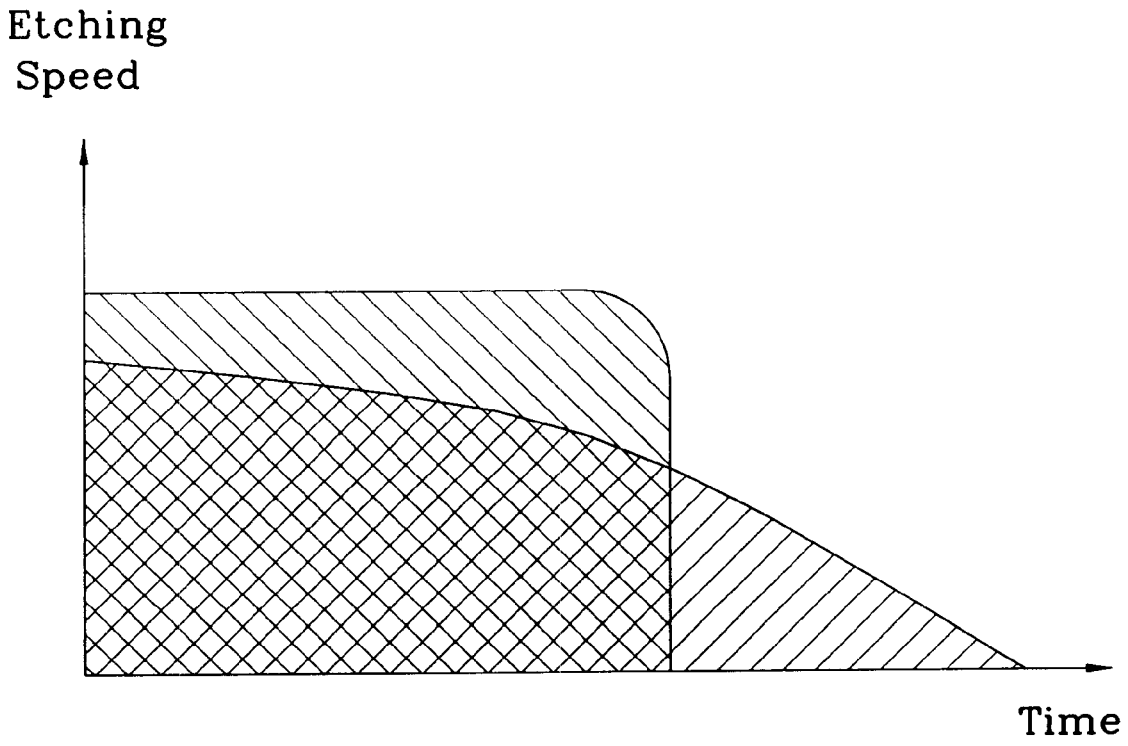
FIG. 13 is a diagram illustrating the relation between an etching speed and an etching time when etching the chamber plate.

For this reason, where the holes 41 remaining after removal of the photoresist 50 are formed in such a manner that they have a width smaller than that of the solution chambers to be formed in the chamber plate, an etching area of the chamber plate is reduced, such that the etching speed is naturally delayed, as shown in FIG. 13. Therefore, the time necessary for the etching becomes long, whereas the solution chambers of a desired shape can be reproduced with accuracy.

In other words, where the etching area, to which an etching solution is supplied, is reduced, an etching speed at the beginning naturally becomes low. Moreover, etching in a vertical direction rapidly progresses due to the self controlling reaction property of an etching solution, but the etching speed becomes slow as the time goes by.

Figure 14:
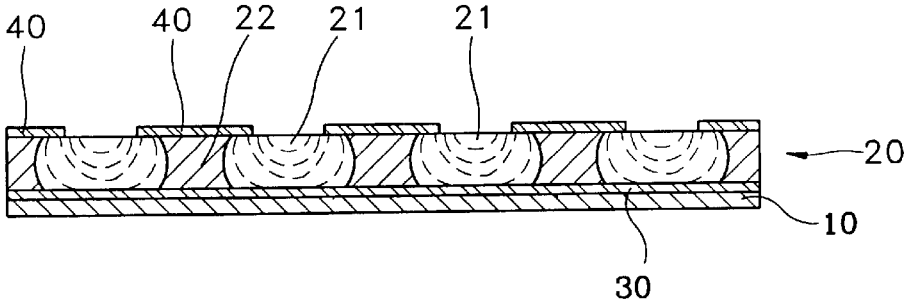
FIG. 14 is a cross-sectional view illustrating a state that the chamber plate is etched when etching while using the second etch stopper film in FIG. 12.

Accordingly, although the etching speed is totally delayed, the etching in a vertical direction rapidly progresses while the etching in a lateral direction slowly progresses and then stops, due to the self controlling reaction property inherent for the etching solution. This, therefore, solves a problem of ununiformity in the solution chambers, which problem has been regarded as most difficult in forming the solution chambers according to the prior art.

Where a time necessary for the etching is delayed while using a slow etching speed at the beginning of the etching as compared to the prior art, an etching effect is obtained in which portions of the chamber plate 20 adjacent to the first etch stopper film 30 and the second etch stopper film 40 are substantially similar in etching degree in a lateral direction, as shown in FIG. 14.

Meanwhile, as the present invention uses a slow etching speed at the beginning of the etching while delaying an overall time necessary for the etching, the present invention is the same in a total eching degree as that of the prior art.

However, the present invention is most remarkably characterized in that reproductivity is improved, such that a plurality of portions of the chamber plate 20 are etched to the same etching degree such that a plurality of the corresponding solution chambers are uniformly formed in the chamber plate 20.

Meanwhile, an etch stopper film has a property of delaying or limiting the etching. Consequently, where the etching is carried out after forming the first hard etch stopper film 30 and the second hard etch stopper film 40 on the opposite surfaces of the chamber plate 20, respectively, as in the present invention, the solution chambers 21 formed in the chamber plate 20 by etching are substantially uniform in etching degree in a lateral direction, by virtue of the self controlling reaction property of an etching solution and the etching delay property by the etch stopper films.

In other words, where the etching is carried out in a vertical direction by an etching solution, the etching in a lateral direction is also carried out to a degree substantially the same as the etching in the vertical direction. In this regard, the etching solution moving in a lateral direction etches the chamber plate 20 in such a manner that the chamber plate 20 is more etched at its middle height portion which is not influenced by the first and second etch stopper films 30 and 40, as compared to its upper and lower height portions adjacent to the first and second etch stopper films 30 and 40, respectively.

As a result, the solution chambers 21 are shaped to be laterally curved at a middle height portion of the chamber plate 20. Consequently, the solution chamber walls 21 that 20 are side walls arranged between adjacent solution chambers 21 have a shape corresponding to the shape of the solution chambers and are shaped to be inwardly laterally curved at their middle height portion.

In other words, the solution chamber walls are shaped to have a width smaller at a middle portion than that of upper and lower portions to which the first etch stopper film and the second etch stopper film are bonded, respectively, thereby increasing a bonding force of the solution chamber walls to the first and second etch stopper films.

Meanwhile, in the multi-layered plate structure in which the vibrating plate 10, the chamber plate 20, the first etch stopper film 30 and the second etch stopper film 40 are laminated as described above, an electrode and a piezoelectric material are sequentially laminated on the vibrating chamber 10 aligned concentrically with the solution chambers. On the other hand, on the second etch stopper film 40 opposite the vibrating chamber 10, there is also bonded a restrictor plate or a channel plate in which an ink channel is formed. In this way, an inkjet print head is fabricated.

The inkjet print head so fabricated is advantageous in that the chamber plate is increased in bonding force to the restrictor plate or the channel plate, as the restrictor plate or the channel plate is bonded to the chamber plate by the second etch stopper film 40 having an increased bonding area, not directly to the channel plate 20.

Meanwhile, in the present invention, assuming that an etching depth for forming the solution chambers 21 in the chamber plate 20 is t and a width of the respective solution chambers formed after etching the chamber plate 20 is W, it is preferred that a width of the respective holes .41 formed in the second etch stopper film 40 after removal of the photoresist 50 is smaller or equal to W-2t.

Furthermore, as described above, the second etch stopper film 40 along with the first etch stopper film serve to limit etching. When etching the chamber plate using the photoresist in accordance with the prior art, there could be the case where open ends of the photoresist are deformed due to an excessive etching. As a result, in the prior art, it is difficult for the solution chambers to be formed uniformly. However, where the second etch stopper film other than the photoresist is formed integrally with the chamber plate 20 as in the present invention, it is advantageous in that the solution chambers are uniformly formed in the chamber plate.

In other words, in the prior art, after the photoresist is first applied on the chamber plate, patterned, partially removed to expose partially the surface of the chamber plate, an etching solution is supplied to the exposed portions of the chamber plate, and etching is carried out to form the solution chambers. In this case, however, the photoresist is inwardly or outwardly bent at its open ends to be deformed, thereby resulting in difficulty in determining an accurate point of time when etching is terminated. As a result, such a prior art is problematic in that the solution chambers are formed in the chamber plate to have a very irregular shape at the solution wall portions upon complete termination of the etching, such that they are non-uniform in shape.

Such a ununiformity in shape of the solution chambers results in difference in a jet pressure of the chamber plates, thereby causing the print quality to be poor.

In the present invention compared to the prior art, in addition to the first etch stopper film, the second etch stopper film is also formed on the surface of the chamber plate toward which an etching solution is supplied. As a result, although etching in a lateral direction is excessively carried out, peripheral edge portions of the holes 40 are not deformed unlike the photoresist in the prior art. This allows etching to be stably carried out and a shape of the formed solution chambers to be non-uniform.

Moreover, in the present invention, the etching speed at the beginning of etching is low, whereas a time for carrying out the etching is delayed such that the etching can be carried out at a slow speed. This provides an advantage in that a point of time when etching is terminated can be stably controlled without a great change in a total etching degree.

Meanwhile, in an actuator in accordance with the prior art, the etch stopper is interposed between the vibrating plate and the chamber plate to form a laminated plate structure having three layers. In contrast with this prior art actuator, an actuator in accordance with the present invention has a structure in which, in addition to the first etch stopper film 30, the second etch stopper film 40 having the same thickness and made of the same material as the first etch stopper film 30 is further laminated integrally, by a photolithographic process, on the chamber plate 20 opposite the first etch film 30. Accordingly, the actuator in accordance with the present invention is structurally characterized in that it has a laminated plate structure of four layers.

Furthermore, in the present invention, the solution chambers having a uniform shape are formed on the chamber plate 20, and the chamber plate 20 after etching has an enlarged bonding area due to the second etch stopper film.

That is to say, as holes 41 formed in the second etch stopper film 40 while communicating with the solution chambers 21 have a width smaller than that of an upper portion of the respective solution chambers 21, an area of the second etch stopper film itself is larger that an area of the second etch stopper film bonded to the respective solution chamber walls 21. Consequently, an area of the second etch stopper film bonded to the restrictor plate or the channel plate becomes larger, thereby increasing a bonding force to the restrictor plate or the channel plate.

Moreover, in the present invention, as the first etch stopper film 30 and the second etch stopper film 40 are formed on the chamber plate 40, it is possible to form uniformly a plurality of the solution chambers having a desired shape and size by etching. In addition, the present invention enables an increase in an area of the chamber plate bonded to the separate channel plate or restrictor plate, as compared with the case where the channel plate or restrictor plate is directly bonded to the solution chamber walls. This allows a bonding force and thus a rigidity of the chamber plate 20 to be increased.

Additionally, the present invention enables the solution chambers to be uniformly formed in the chamber plate 20 by etching due to the first and second etch stopper films. Consequently, the present invention is highly advantageous in mass production of actuators by a batch process.

As apparent from the above description, therefore, the present invention is advantageous in that it substantially eliminates a positional difference of the solution chambers while highly reducing equipment and material costs, compared to a method of forming the solution chambers by a mechanical processing. Moreover, the present invention is excellent in reproductivity of the solution chambers, compared to a method of using a photoresist as an etching limit means. In the present invention, particularly, the second etch stopper film is formed, whereby a bonding area of the chamber plate to other structures, such as the restrictor plate or the channel plate becomes larger to increase a bonding force of the channel plate. This allows a rigidity of the chamber plate to be increased while improving an ink jetting-out performance of an inkjet print head.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An actuator for an inkjet print head comprising:

a vibrating plate having a thin film structure and flexurally deformable in its thickness direction;

a first etch stopper film laminated on one surface of the vibrating plate and serving to prevent the vibrating plate from etching;

a chamber plate laminated on the surface of the first etch stopper film opposite to the vibrating plate, the chamber plate having a plurality of solution chambers formed therein and spaced apart from each other by a desired distance, the chamber plate serving to introduced or jet out ink with the flexural deformation of the vibrating plate; and a second etch stopper film laminated on the surface of the chamber plate opposite to the first etch stopper film, the second etch stopper film including through holes formed therein, the through holes being formed such that they communicated vertically concentrically with the corresponding ones of the solution chambers, the through holes having a width smaller than that of the solution chambers, whereby the second etch stopper film has an increased bonding area;

in which the holes formed in the second etch stopper film have a width which meets the following equation:

$$B \leqq W-2t$$

where, B is a width of the respective holes, t is an etching depth of the chamber plate, and W is a width of the upper portion of the respective solution chambers formed after etching.

2. The actuator of the inkjet print head of claim 1, in which the solution chambers in the chamber plate are partitioned by the corresponding one of a plurality of solution chamber walls formed on the chamber plate in such a manner that they have a thickness thinner at a middle portion than at an upper portion and a lower portion.

3. The actuator of the inkjet print head of claim 2, in which the second etch stopper film has a thickness in the range of 0.1 $\mu$m to 10 $\mu$m.

* * * * *